United States Patent [19]

Kasai

[11] Patent Number: 4,520,535

[45] Date of Patent: Jun. 4, 1985

[54] SLIDE FASTENER HAVING DISCRETE COUPLING ELEMENTS

[75] Inventor: Kazumi Kasai, Namerikawa, Japan

[73] Assignee: Yoshida Kogyo K. K., Tokyo, Japan

[21] Appl. No.: 492,142

[22] Filed: May 6, 1983

[30] Foreign Application Priority Data

May 7, 1982 [JP] Japan ..... 57-66159[U]

[51] Int. Cl.[3] ..... A44B 19/00

[52] U.S. Cl. ..... 24/410

[58] Field of Search ..... 24/409, 410, 411

[56] References Cited

U.S. PATENT DOCUMENTS

| | | | |
|---|---|---|---|
| 2,526,600 | 10/1950 | Bolten, Jr. | 24/410 |
| 2,790,223 | 4/1957 | Morin | 24/410 |
| 2,798,275 | 7/1957 | Morin | 24/410 |
| 2,942,317 | 6/1960 | Morin | 24/410 |
| 3,068,541 | 12/1962 | Morin | 24/410 |
| 3,238,285 | 3/1966 | Morin | 24/410 X |

*Primary Examiner*—Philip C. Kannan

*Attorney, Agent, or Firm*—Hill, Van Santen, Steadman & Simpson

[57] ABSTRACT

A slide fastener comprises discrete coupling elements each having a pair of upper and lower coupling portions disposed one on each side of the plane of a stringer tape. The upper coupling portion has an arcuate head and a reduced neck integral therewith and complementary in shape thereto, the neck being defined by a pair of recesses. The lower coupling portion has a pair of substantially triangular shoulders extending laterally in opposite directions over the recesses beyond the width of upper and lower legs extending from the neck away from the head. Each shoulder is defined by an angled sidewall blending at one end with the lower leg adjacent to a corresponding one end of the sidewall of the neck and intersecting the opposite end of the neck's sidewall.

2 Claims, 4 Drawing Figures

SLIDE FASTENER HAVING DISCRETE COUPLING ELEMENTS

BACKGROUND OF THE INVENTION

1. Field of the Invention

The present invention relates generally to slide fasteners and more particularly to slide fasteners of the type having a series of descrete coupling elements secured to each of a pair of oppositely disposed stringer tapes.

2. Prior Art

Slide fasteners of the type described are known, wherein each individual coupling element has a pair of lateral shoulders extending over a pair of arcuate recesses defining a reduced neck extending between a rounded coupling head and a leg portion at which the coupling element is secured to a stringer tape. Each pair of shoulders is engageable with the coupling heads of a pair of adjacent mating coupling elements when the two stringer tapes are taken into engagement with each other, so as to limit relative tilting displacement of the coupled adjacent coupling elements when the stringer tapes are flexed, and to reinforce the reduced necks of the coupling elements.

In one such known slide fastener shown in U.S. Pat. No. 2,526,600, patented Oct. 17, 1950, the shoulders extend laterally in opposite directions to the maximum width of each coupling element as measured at the leg portion. A drawback of the known slide fastener is that when severe bending or torsional stresses are applied to the stringer tapes, the shoulders supporting thereon the coupling heads are susceptible to accidental separation from the latter, resulting in a malfunctioning slide fastener. The coupling elements are sometimes broken at the reduced necks.

Another prior art slide fastener disclosed in U.S. Pat. No. 2,942,317, patented June 28, 1960, has coupling elements each including a pair of projections extending from the respective shoulders laterally beyond the width of the coupling element for increasing the area of the shoulders. The slide fastener having such coupling elements is disadvantageous in that fibrous materials of a garment to which the slide fastener is attached or of another garment tend to be caught on the projections while the slide fastener is in use or when the garments are washed.

SUMMARY OF THE INVENTION

A slide fastener compreses discrete coupling elements each having a pair of upper and lower coupling portions disposed one on each side of the plane of a stringer tape. The upper coupling portion has an arcuate head and a reduced neck integral therewith and complementary in shape thereto, the neck being defined by a pair of recesses. The lower coupling portion has a pair of substantially triangular shoulders extending laterally in opposite directions over recesses beyond the width of upper and lower legs extending from the neck away from the head. Each shoulder is defined by an angled sidewall blending at one end with the lower leg adjacent to a corresponding one end of the sidewall of the neck and intersecting the opposite end of the neck's sidewall.

It is an object of the present invention to provide a slide fastener having discrete coupling elements which once coupled together are retained in place against displacement relative to each other, particularly in a direction perpendicular to the plane of the slide fastener, even when the latter is subjected to severe longitudinal or lateral bending stresses, or torsional stresses while in use.

Another object of the present invention is to provide a slide fastener which is free from fibrous materials being caught on its coupling elements.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
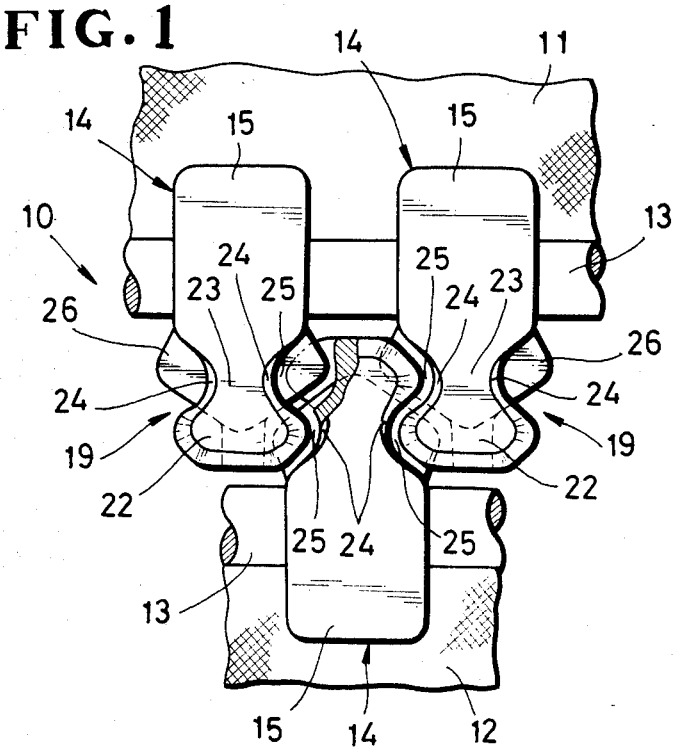
FIG. 1 is a fragmenrary top view of a slide fastener according to the present invention, showing the coupling elements on respective stringer tapes coupled together.

The principles of the present invention are particularly useful when embodied in a slide fastener such as shown in FIG. 1, generally indicated by the numeral 10.

The slide fastener 10 comprises a pair of identical stringer tapes 11,12, the opposed longitudinal edges of which are beaded or reinforced as indicated at 13. A series of uniformly spaced coupling elements 14 is carried on the beaded edge 13 of each stringer tape 11,12. The coupling elements 14 on the stringer tapes 11,12 are taken into and out of interdigitating engagement with each other by a reciprocating slider (not shown) to close and open the slide fastener 10 in the usual manner.

Figure 2:
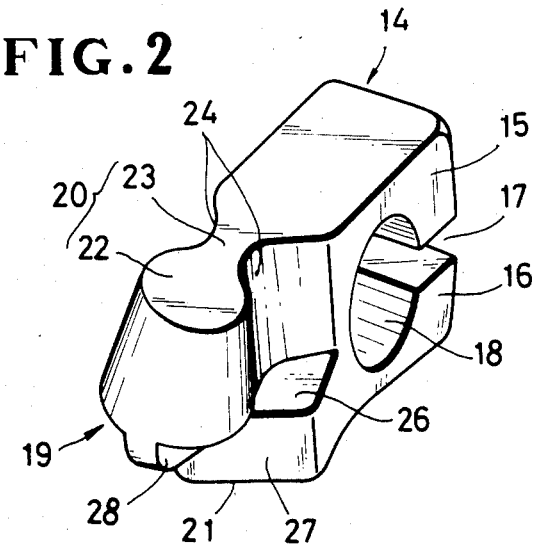
FIG. 2 is an enlarged perspective view of one individual coupling element.

As shown in FIG. 2, each of the coupling elements 14 comprises a generally rectangular body having upper and lower legs 15,16 spaced apart from each other and a transversely extending slot 17 embracing the inner longitudinal edge portion of the stringer tape 11,12 (FIGS. 1 and 2). The slot 17 is enlarged into a substantially circular cross section as at 18 for receiving the beaded edge 13 (FIGS. 1 and 2) of the stringer tape 11,12. The body of each coupling element 14 also includes a coupling end portion 19 extending forwardly from the upper and lower legs 15,16 and projecting beyond the beaded edge 13 of the stringer tape 11,12 at right angles to the axis of the slide fastener 10.

As shown in FIG. 2, the coupling end portion 19 has a pair of upper and lower (first and second) coupling portions 20,21 located one on each side of the plane of the stsringer tapes 11, 12 (FIGS, 1 and 2). The upper coupling portion 20 has a rounded arcuated head 22 and a reduced neck 23 integral therewith. The neck 23 has a pair of arcuate sidewalls 24,24 respectively defining a pair of recesses 25,25 (FIG. 1) disposed symmetrically with respect to the axis of the coupling element body. The head 22 and the neck 23 are complementary in shape with each other so as to be interengageable upon movement of the slider in a direction to close the slide fastener 10.

Figure 3:
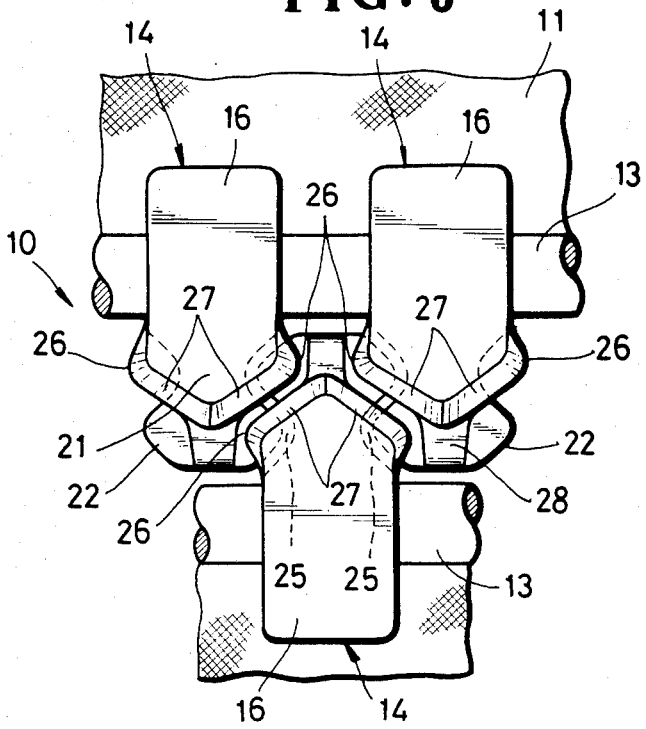
FIG. 3 is a fragmentary bottom view of the slide fastener.
Figure 4:
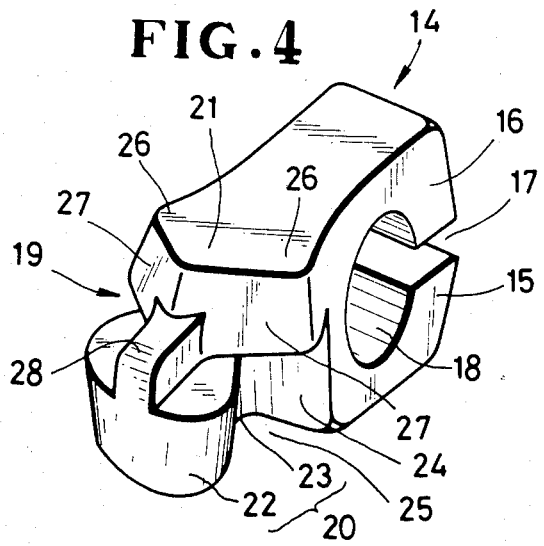
FIG. 4 is a view similar to FIG. 2, showing the reverse side of the coupling element.

As shown in FIGS. 3 and 4, the lower coupling portion 21 is shorter than the upper coupling portion 20 and has a generally pentahedral shape having a pair of substantially triangular wings or shoulders 26, 26. The shoulders 26, 26 extend laterally in opposite directions at the recesses 25, 25 beyond the width of the legs 15, 16, thereby providing a wider area for stable engagement with the heads 22 of coupled adjacent coupling elements 14. The shoulders 26,26 also serve to reinforce the neck 23 of the upper coupling portion 20. Each of the shoulders 26, 26 is defined by an angled sidewall 27 blending at one end with the lower leg 16 adjacent to a corresponding one end of the sidewall 24 of the neck 23. The sidewalls 27, 27 extend to intersect the opposite end of each sidewall 24 and converge at the respective opposite ends to form an apex, the apex being located substantially at the center of the head 22. In other words, the sidewalls 27,27 extend divergently from one end of the neck 23 adjacent to the legs 15,16 to points beyond the width of the legs 15,16 from which they extend convergently across the other end of the neck 23 to the apex of the lower coupling portion 21 located on the head 22. The upper coupling portion 20 has an average width as measured at the opposite end of the neck 23. A reinforcing rib 28 extends axially centrally of the coupling element 14 on and across the head 22 and blends at one end into the apex of the pentahedral lower coupling portion 21. The rib 28 is relatively thin but has a thickness enough to reinforce the head 22.

When the coupling elements 14,14 on the stringer tapes 11,12 are coupled together, the head 22 of one coupling element 14 is received in the recesses 25,25 in the adjacent coupling elements 14,14 and is supported on the triangular shoulders 26,26 of the latter. The shoulders 26,26 engage the head 22 to limit relative tilting displacement of coupled adjacent coupling elements 14,14 when the stringer tapes 11,12 are flexed under longitudinal or lateral bending stresses, or torsional stresses while in use. Thus, the stringer tapes 11,12 can be maintained in their properly coupled condition without encountering any unintentional disengagement or mismeshing of the coupling elements 14,14. Since the shoulders 26,26 are substantially triangular shape, the coupling elements 14,14 are less liable to catch fibrous materials on their shoulders 26,26 while the slide fastener is in use or when a garment carrying the slide fastener 10 is washed solely or with another garment.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A slide fastener comprising:

(a) a pair of stringer tapes; and (b) a series of uniformly spaced coupling elements carried on each of said stringer tapes, each said coupling element having a generally rectangular body which has a coupling end portion and a pair of parallel spaced apart legs extending axially rearwardly therefrom to hold a longitudinal edge portion of each of said stringer tapes therebetween, said coupling end portion projecting beyond said longitudinal edge portion at a right angle to the axis of the slide fastener, and having (1) a first coupling portion located on one side of the plane of said stringer tapes, said first coupling portion having a rounded head and a neck integral therewith, said head and said neck being complementary in shape to each other, said neck having a pair of arcuate first sidewalls respectively defining a pair of recesses disposed symmetrically with respect to the axis of said body, and (2) a second coupling portion located on the other side of the plane of said stringer tape, said second coupling portion having a pair of second sidewalls each having a first planar portion extending obliquely outwardly from respective opposite sides of one of said legs to a turning point beyond the width of said legs, and a second planar portion extending obliquely inwardly from said turning point to intercept one end of said first sidewalls respectively adjacent to said rounded head, thereby defining a pair of shoulders at the ends of said recesses which extend laterally in opposite directions beyond the width of said legs.

2. A slide fastener according to claim 1, said second planar portions converging at an obtuse angle at the center of said head to form an apex.

* * * * *